US010826220B1

(12) United States Patent
Butcher et al.

(10) Patent No.: US 10,826,220 B1
(45) Date of Patent: Nov. 3, 2020

(54) ELECTRICAL CONNECTOR HAVING ELECTRICAL TERMINAL SERVICING FEATURE

(71) Applicant: Lear Corporation, Southfield, MI (US)

(72) Inventors: Anthony Butcher, Troy, MI (US); David Menzies, Linden, MI (US); Bhupinder Rangi, Novi, MI (US); Yefim Grinshpun, Southfield, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/582,442

(22) Filed: Sep. 25, 2019

(51) Int. Cl.
*H01R 13/42* (2006.01)
*H01R 13/502* (2006.01)

(52) U.S. Cl.
CPC ..... *H01R 13/42* (2013.01); *H01R 13/502* (2013.01)

(58) Field of Classification Search
CPC ..... H01R 13/42–4368
See application file for complete search history.

(56) References Cited

U.S. PATENT DOCUMENTS

| | | | | |
|---|---|---|---|---|
| 7,867,042 | B2 * | 1/2011 | Shuey | H01R 13/4365 439/595 |
| 7,914,327 | B2 * | 3/2011 | Campbell | H01R 13/4365 439/595 |
| 8,210,864 | B1 * | 7/2012 | Hernandez | H01R 13/4223 439/352 |
| 9,246,255 | B1 | 1/2016 | Holthus et al. | |
| 9,350,116 | B1 | 5/2016 | Morello et al. | |
| 9,407,026 | B2 | 8/2016 | Campbell et al. | |
| 9,705,228 | B2 * | 7/2017 | Caldwell | H01R 13/641 |
| 9,755,349 | B1 * | 9/2017 | Kim | H01R 13/5202 |
| 9,847,601 | B2 * | 12/2017 | Menard | H01R 13/4223 |
| 9,899,761 | B2 * | 2/2018 | Schroll | H01R 13/4365 |
| 9,917,381 | B1 * | 3/2018 | Campbell | H01R 9/16 |
| 10,050,382 | B2 * | 8/2018 | Droesbeke | H01R 13/506 |

FOREIGN PATENT DOCUMENTS

EP 3171459 A1 5/2017

* cited by examiner

*Primary Examiner* — Edwin A. Leon
*Assistant Examiner* — Milagros Jeancharles
(74) *Attorney, Agent, or Firm* — MacMillan, Sobanski & Todd, LLC

(57) ABSTRACT

An electrical connector includes a housing having an interior space and a retaining finger extending into the interior space. An electrical terminal and a terminal position assurance are each disposed within the interior space of the housing. The terminal position assurance is movable relative to the housing between (1) a pre-lock position, wherein the retaining finger prevents the electrical terminal from being withdrawn from the interior space of the housing, and the terminal position assurance does not prevent the retaining finger from moving relative to the housing; (2) a service position, wherein the retaining finger does not prevent the electrical terminal from being withdrawn from the interior space of the housing; and (3) a lock position, wherein the retaining finger prevents the electrical terminal from being withdrawn from the interior space of the housing, and the terminal position assurance prevents the retaining finger from moving relative to the housing.

12 Claims, 7 Drawing Sheets

(PRE-LOCK ORIENTATION)

(SERVICE ORIENTATION)

(LOCK ORIENTATION)

ELECTRICAL CONNECTOR HAVING ELECTRICAL TERMINAL SERVICING FEATURE

BACKGROUND OF THE INVENTION

This invention relates in general to electrical distribution systems that supply electrical energy from a source of electrical energy to one or more electrically operated devices. In particular, this invention relates to an improved structure for an electrical connector for releasably connecting the source of electrical energy to one of the electrically operated devices in such an electrical distribution system.

In a conventional electrical distribution system, a source of electrical energy (such as a generator or a battery) is connected to supply electrical energy through one or more electrical conductors (such as wires or bus bars) to respective electrically operated devices. To facilitate the assembly and maintenance of the electrical distribution system, it is often desirable that some or all of the electrically operated devices be releasably connected to their respective electrical conductors. This can be accomplished by providing mating electrical connectors on the electrical conductors and the electrically operated devices. These mating electrical connectors are designed to selectively connect and disconnect the electrical conductors to and from their respective electrically operated devices, both mechanically and electrically.

A conventional electrical connector includes an electrically non-conductive housing that supports an electrically conductive terminal therein. Typically, the electrical terminal is protectively enclosed within an interior of the housing to prevent it from unintended contact during installation and use. The housing usually includes one or more retainers that are adapted to cooperate with corresponding retainer(s) provided on the mating electrical connector to provide a releasable mechanical connection therebetween. Many conventional electrical connectors additionally include a terminal position assurance that ensures that the electrical terminal is properly positioned within the interior of the housing and is positively retained thereto.

A wide variety of electrical connector structures are known in the art and have functioned satisfactorily. However, it is also known that in some instances, it may be desirable to remove the electrical terminal from the housing for service. In most known electrical connectors, a service tool is required to disconnect the electrical terminal from the housing for removal and service. Thus, it would be desirable to provide an improved electrical connector that allows the electrical terminal to the disconnected and removed from the housing without the need for a service tool.

SUMMARY OF THE INVENTION

This invention relates to an improved structure for an electrical connector that allows an electrical terminal to be disconnected and removed from a housing without the need for a service tool. The electrical connector includes a housing having an interior space and a retaining finger extending into the interior space. An electrical terminal and a terminal position assurance are each disposed within the interior space of the housing. The terminal position assurance is movable relative to the housing between (1) a pre-lock position, wherein the retaining finger prevents the electrical terminal from being withdrawn from the interior space of the housing, and the terminal position assurance does not prevent the retaining finger from moving relative to the housing; (2) a service position, wherein the retaining finger does not prevent the electrical terminal from being withdrawn from the interior space of the housing; and (3) a lock position, wherein the retaining finger prevents the electrical terminal from being withdrawn from the interior space of the housing, and the terminal position assurance prevents the retaining finger from moving relative to the housing.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
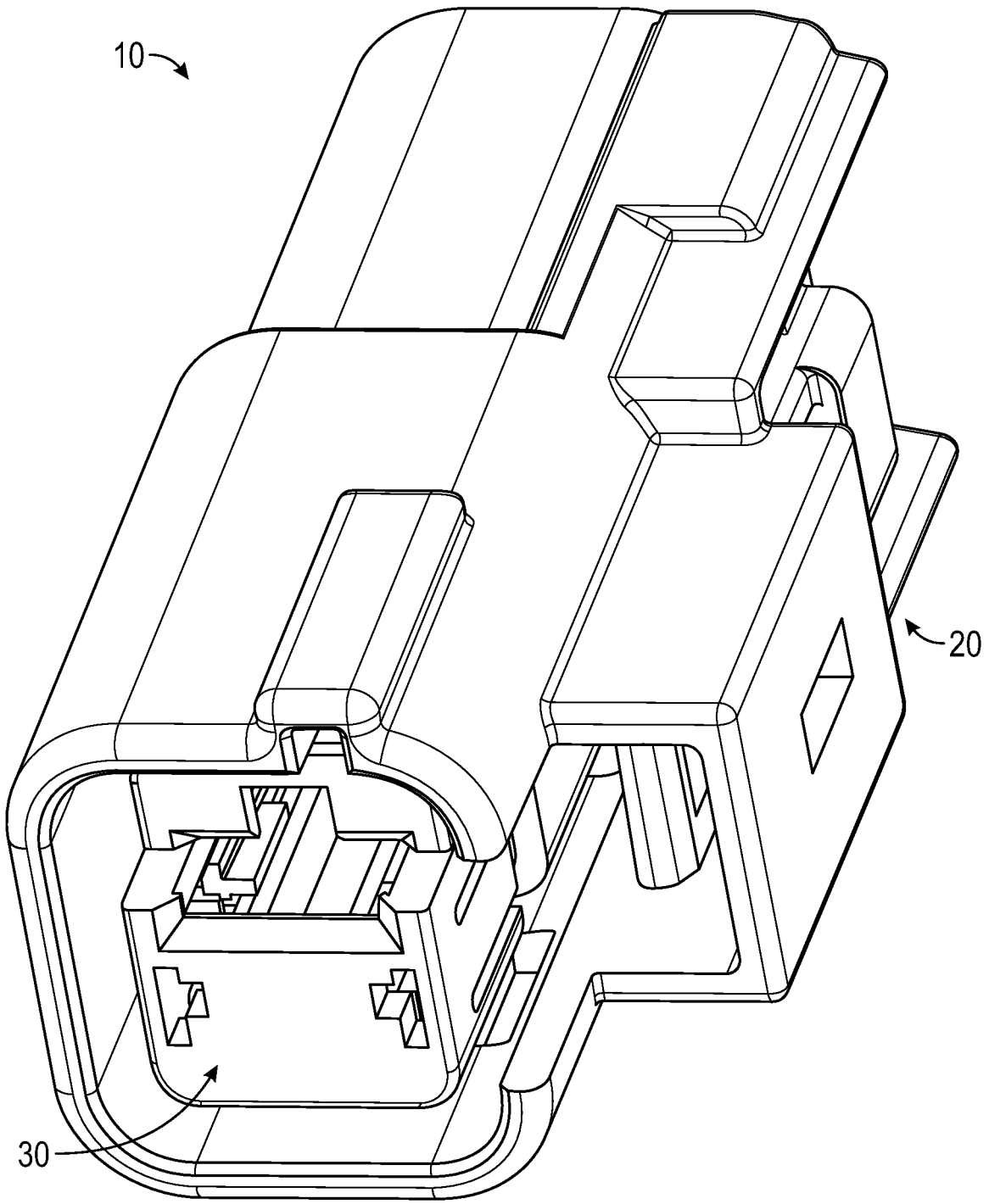
FIG. 1 is a perspective view of an improved structure for an electrical connector in accordance with this invention.

Referring now to the drawings, there is illustrated in FIG. 1 an improved structure for an electrical connector, indicated generally at 10, in accordance with this invention. As is well known, the electrical connector 10 may be used for selectively connecting first and second components in an electrical distribution system (not shown). However, the electrical connector 10 of this invention may be used in any desired electrical circuit or other environment for any desired purpose.

Figure 4:
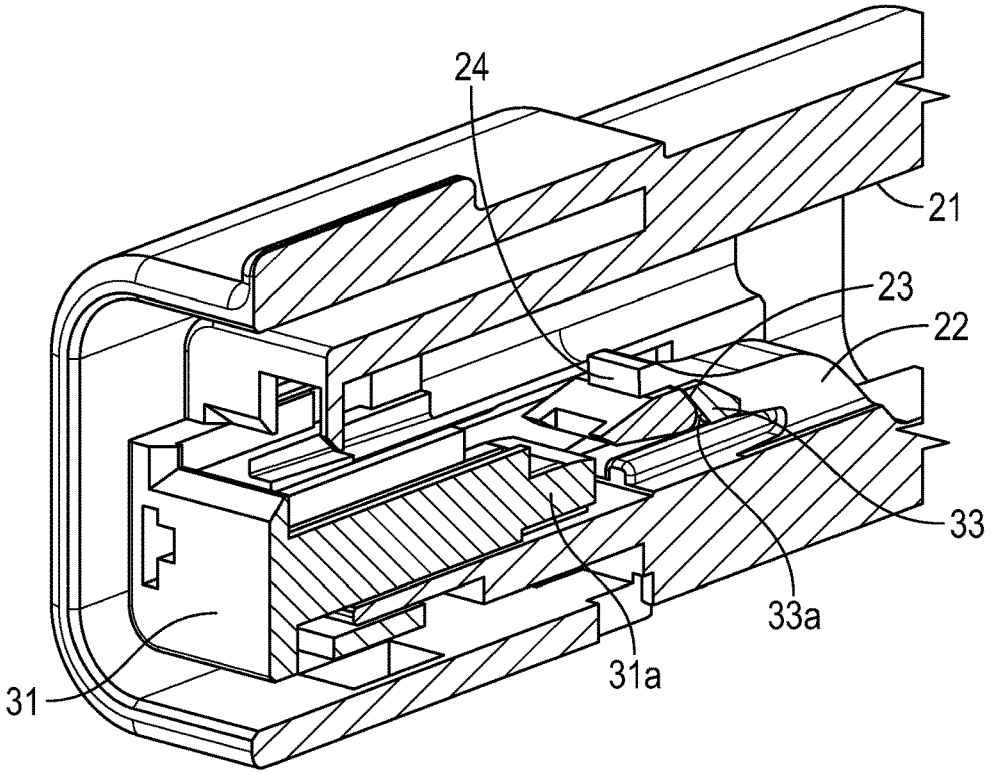
FIG. 4 is a side perspective view, partially in cross section, of the housing and the terminal position assurance shown in a pre-lock position.

The electrical connector 10 includes an outer housing, indicated generally at 20. The structure of the housing 20 is clearly illustrated in FIGS. 2, 4, and 5. As shown therein, the illustrated housing 20 is shaped generally in the form of a hollow rectangular parallelepiped that defines a longitudinally extending interior space 21. However, the housing 20 may be formed having any desired shape. The housing 20 is preferably molded from a single piece of an electrically non-conductive material, although it may be formed in any desired manner and from any desired material.

Figure 2:
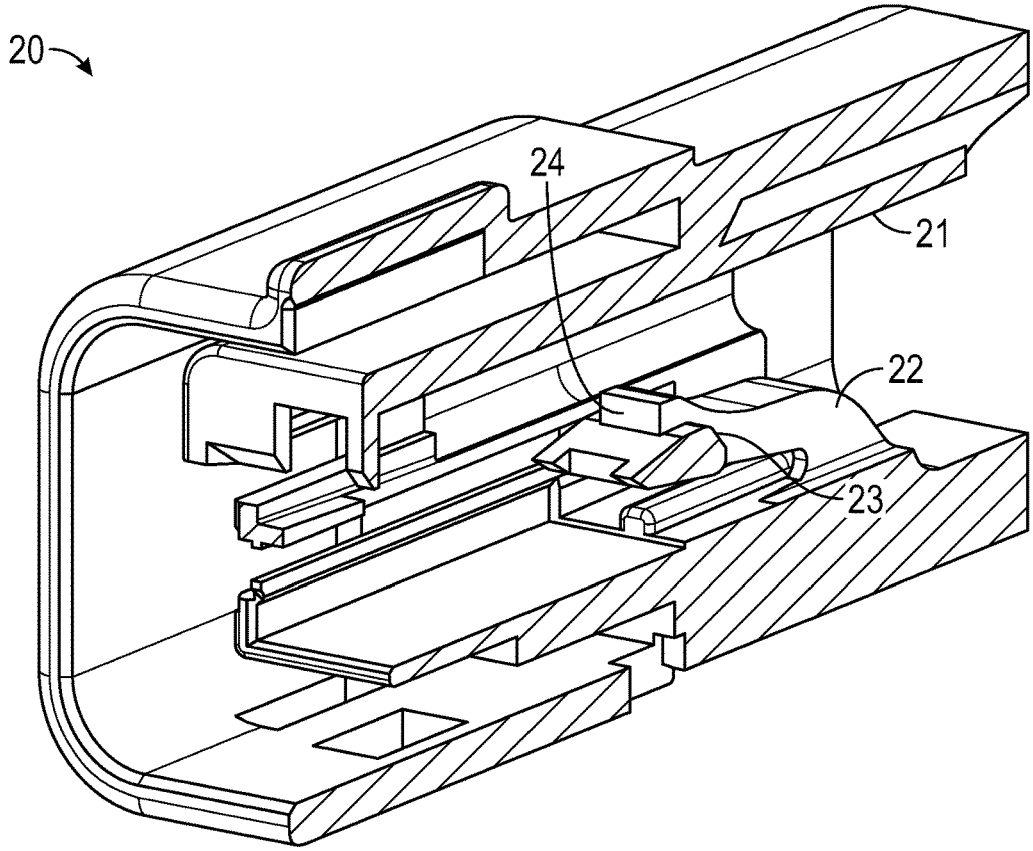
FIG. 2 is a perspective view, partially in cross section, of a housing of the electrical connector illustrated in FIG. 1.

The housing 20 of the electrical connector 10 includes a retaining finger 22 that extends within the interior space 21. In the illustrated embodiment, the retaining finger 22 is a cantilevered member that extends generally longitudinally throughout a portion of the interior space 21. The illustrated retaining finger 22 terminates in an actuating surface 23 that is oriented at an angle relative to the longitudinally extending interior space 21 of the housing 20. An upstanding terminal lock member 24 is provided on the retaining finger 22 adjacent to the actuating surface 23. As best shown in FIG. 2, the housing 20, the retaining finger 22, and the terminal lock member 24 are all molded integrally from a single piece of an electrically non-conductive material. However, the housing 20, the retaining finger 22, and the terminal lock member 24 may be formed in any desired manner and from any desired material or combination of materials. The purposes for the retaining finger 22, the actuating surface 23, and the terminal lock member 24 will be explained in detail below.

Figure 5:
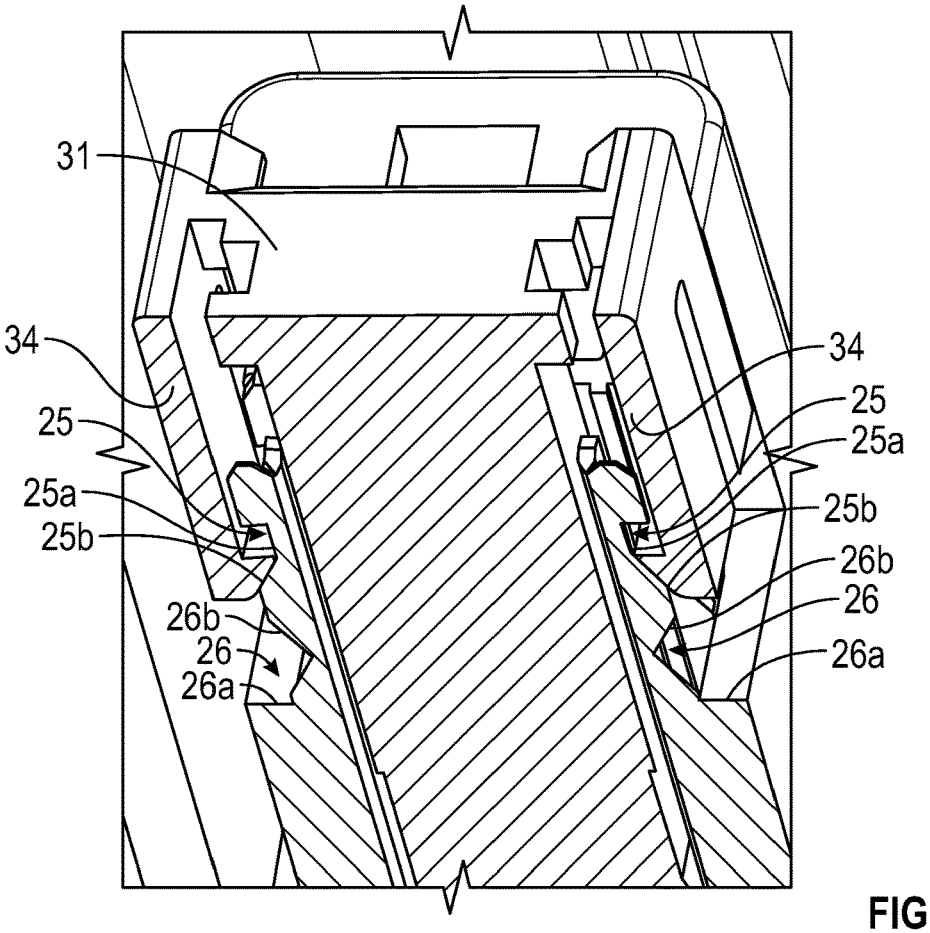
FIG. 5 is a bottom perspective view, partially in cross section, of the housing and the terminal position assurance shown in the pre-lock position illustrated in FIG. 4.
Figure 6:
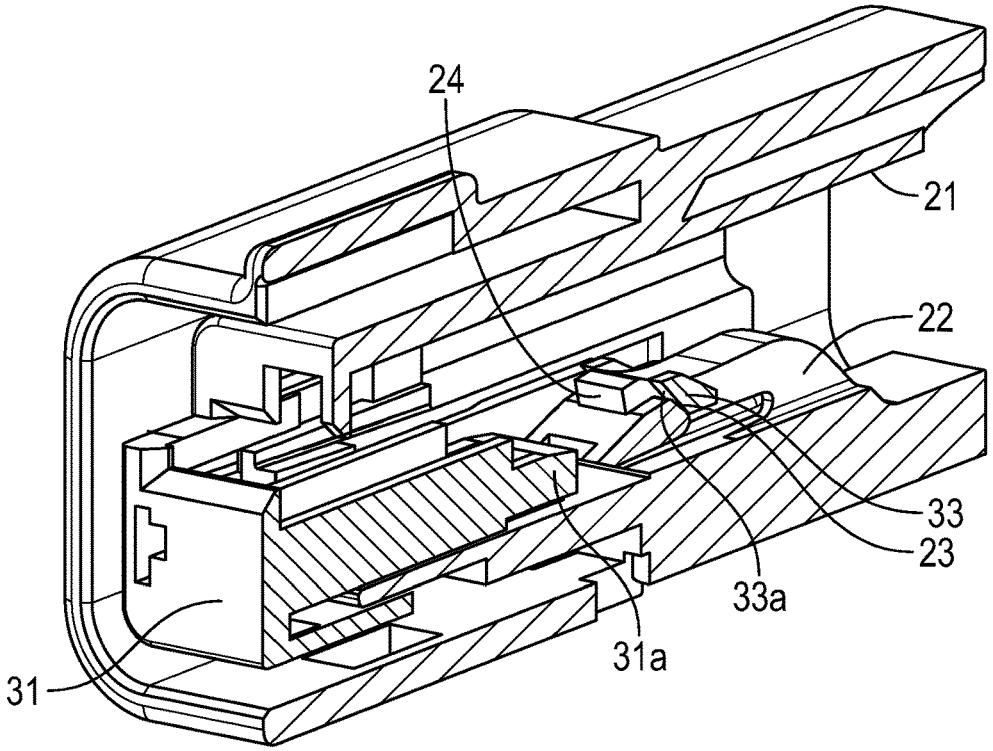
FIG. 6 is a side perspective view, partially in cross section, of the housing and the terminal position assurance shown in a service position.

As best shown in FIG. 5, the housing 20 of the electrical connector 10 further includes a pair of first retaining recesses, indicated generally at 25, and a pair of second retaining recesses, indicated generally at 26. In the illustrated embodiment, each of the first pair of retaining recesses 25 is disposed longitudinally adjacent to a corresponding one of the pair of second retaining recesses 26. However, any desired number of such first and second retaining recesses 25 and 26 may be provided at any desired locations within the interior space 21 of the housing 20. Also, either or both of the first and second retaining recesses 25 and 26 may be embodied as any other desired positioning mechanism in the housing 20.

Each of the first retaining recesses 25 provided in the housing 20 includes a stop surface 25*a* and a ramp surface 25*b*. Similarly, each of the second retaining recesses 26 provided in the housing 20 also includes a stop surface 26*a* and a ramp surface 26*b*. The illustrated stop surfaces 25*a* and 26*a* extend generally perpendicularly from the longitudinally extending interior portion 21 of the housing 20, while the illustrated ramp surfaces 25*b* and 26*b* extend at a non-right angle relative thereto. However, the first and second retaining recesses 25 and 26 may have any desired shape or combination of shapes. The purposes for the first and second retaining recesses 25 and 26 will be explained below.

Figure 3:
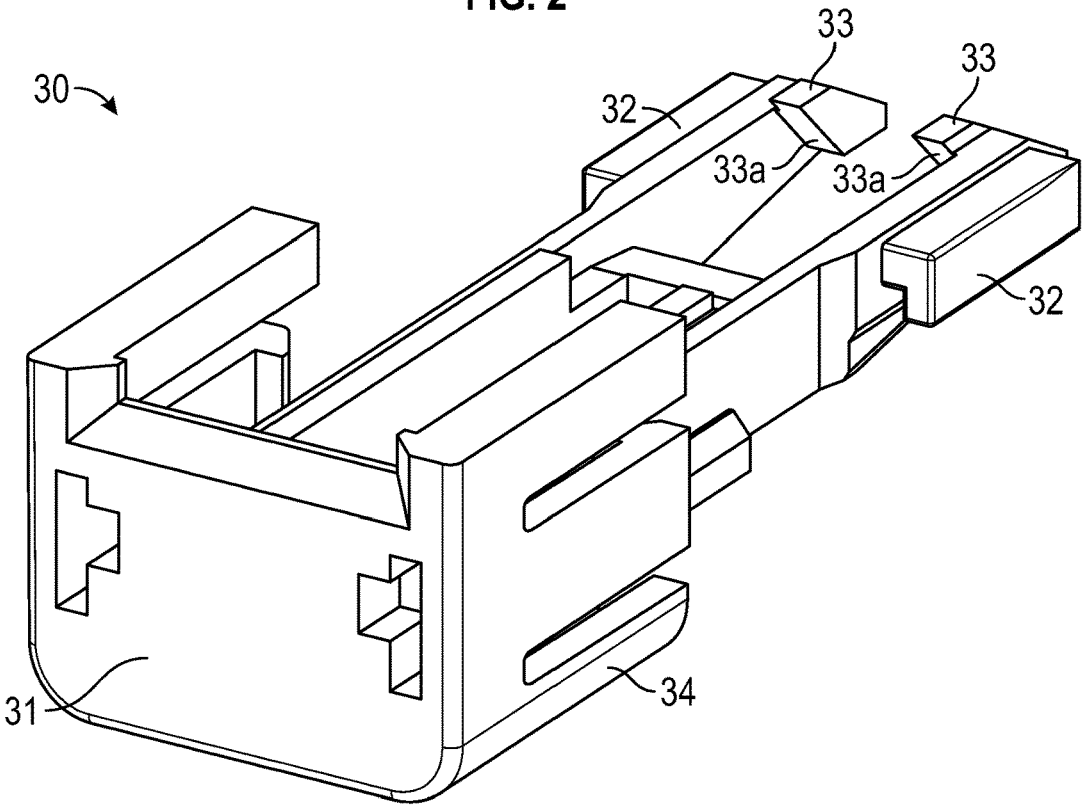
FIG. 3 is a perspective view of a terminal position assurance of the electrical connector illustrated in FIG. 1.

The electrical connector 10 also includes a terminal position assurance, indicated generally at 30. The structure of the terminal position assurance 30 is clearly illustrated in FIGS. 3, 4, and 5. As shown therein, the illustrated terminal position assurance 30 includes a body 31 having a locking portion 31*a* extending generally longitudinally therefrom. The purpose of the locking portion 31*a* of the body 31 will be explained below. Also, a pair of opposed actuating arms 32 extend generally longitudinally from the body 31 of the terminal position assurance 30. As best shown in FIG. 3, the actuating arms 32 terminate in respective actuators 33 that extend inwardly toward one another. Each of the actuators 33 has an angled actuating surface 33*a* provided thereon. In the illustrated embodiment, the actuating arms 32 and the actuators 33 are all molded integrally from a single piece of an electrically non-conductive material. However, any desired number of such actuating arms 32 and actuators 33 may be formed in any desired manner and from any desired material or combination of materials. The purpose for the actuating arms 32, the actuators 33, and the actuating surfaces 33*a* will also be explained below.

As best shown in FIG. 5, the terminal position assurance 30 further includes a pair of retainers, indicated generally at 34, that also extend generally longitudinally from the body 31. As best shown in FIG. 5, the retainers 34 terminate in respective protrusions 35 that extend inwardly toward one another. In the illustrated embodiment, each of the retainers 35 includes a first surface 35*a* and a second surface 35*b*. The illustrated first surfaces 35*a* each extend generally perpendicularly from the longitudinally extending retainers 35, while the illustrated second surfaces 35*b* each extend at a non-right angle relative thereto. However, the first and second surfaces 35*a* and 35*b* may have any desired shape or combination of shapes. The purposes for the first and second surfaces 35*a* and 35*b* will be explained below.

Figure 8:
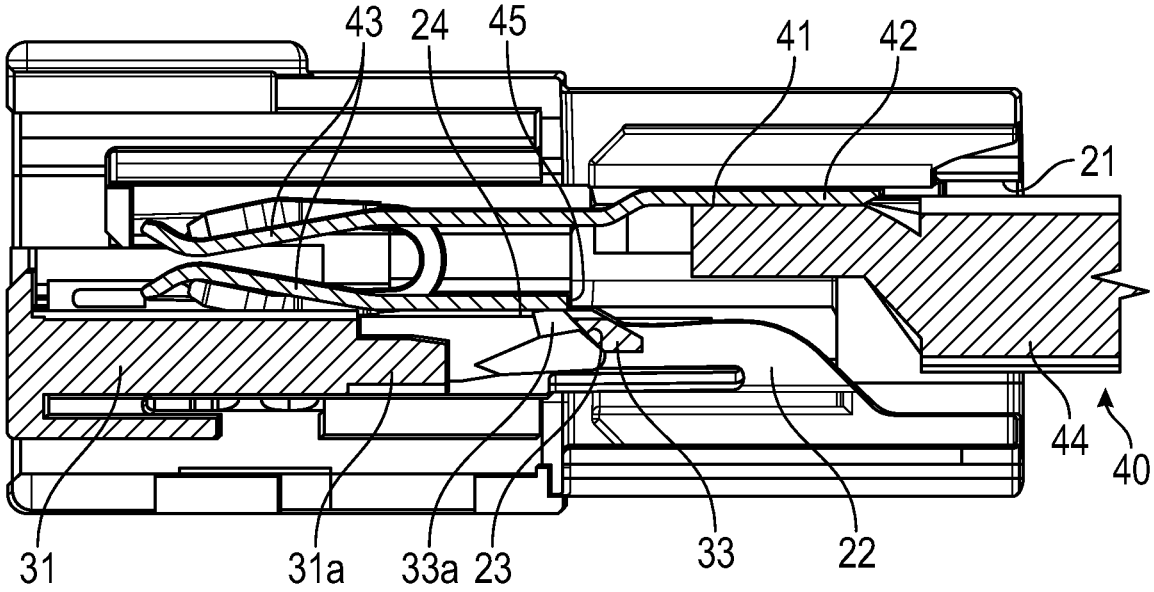
FIG. 8 is a side elevational view, partially in cross section, of the housing and the terminal position assurance shown in the service position illustrated in FIGS. 6 and 7, and further showing an electrical terminal installed therein.
Figure 9:
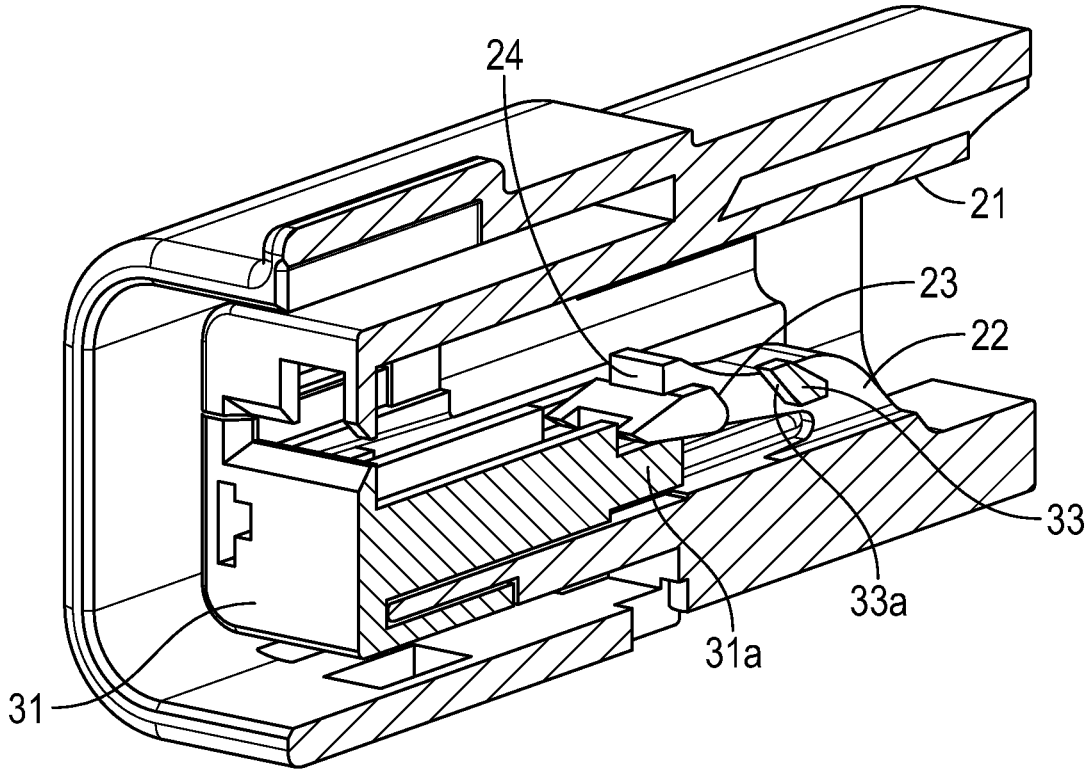
FIG. 9 is a side perspective view, partially in cross section, of the housing and the terminal position assurance shown in a lock position.
Figure 11:
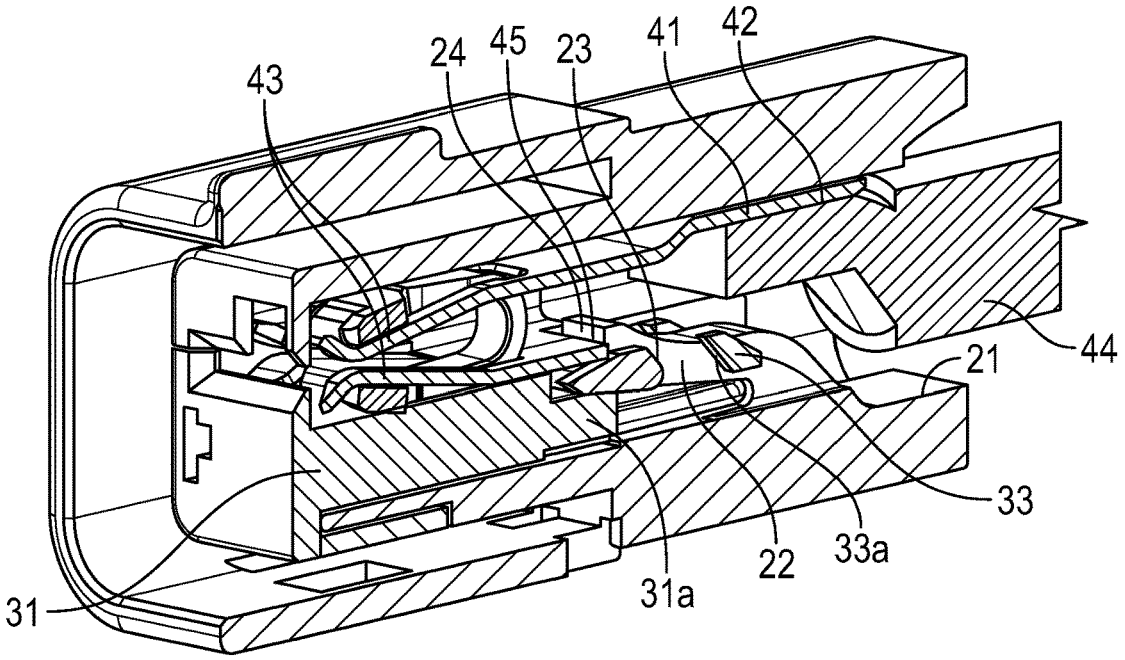
FIG. 11 is a side perspective view, partially in cross section, of the housing and the terminal position assurance shown in the lock position illustrated in FIGS. 9 and 10, and further showing the electrical terminal installed therein.

The electrical connector 10 further includes an electrical terminal and wire assembly, indicated generally at 40. The structure of the electrical terminal and wire assembly 40 is clearly illustrated in FIGS. 8 and 11. As shown therein, the illustrated electrical terminal and wire assembly 40 includes an electrical terminal 41 having a connection portion 42 that extends therefrom in a first generally longitudinal direction and a terminal portion 43 that extends therefrom in a second generally longitudinal direction that is opposite to the first generally longitudinal direction. The illustrated connection portion 42 is adapted to be secured to a wire 44 or other electrical conductor in a conventional manner. The illustrated terminal portion 43 is a female terminal that is adapted to selectively engage a corresponding male terminal (not shown) in a conventional manner. The electrical terminal 41 is preferably formed from an electrically conductive material, such as copper or aluminum. However, the electrical terminal 41 may be embodied having any desired structure and be formed from any desired material or combination of materials.

The electrical terminal 41 is provided with a locking surface 45. In the illustrated embodiment, the locking surface 45 is provided on the terminal portion 43 of the electrical terminal 41. However, the locking surface 45 may be provided at any desired location on the electrical terminal 41. The purpose of the locking surface 45 will be explained below.

Figure 12:
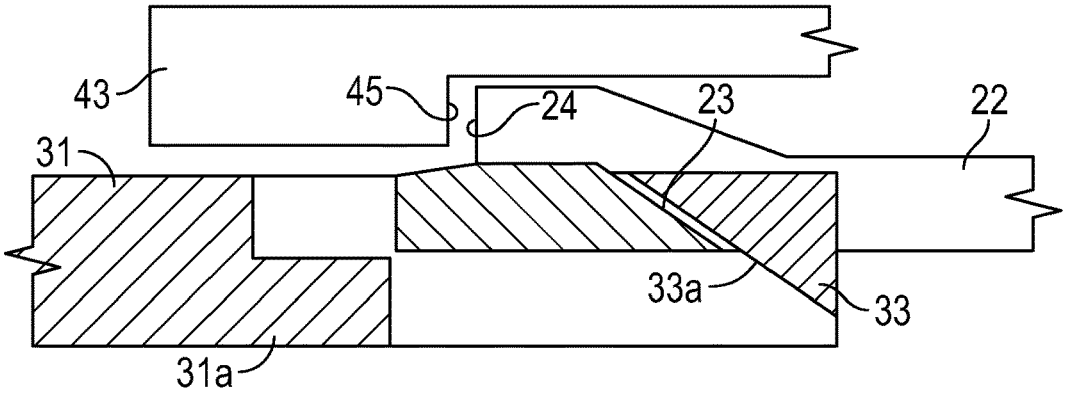
FIG. 12 is a schematic side elevational view showing the relative orientations of portions of the housing, the terminal position assurance, and the electrical terminal when the terminal position assurance is in the pre-lock position.

To assemble the electrical connector 10, the terminal position assurance 30 and the electrical terminal and wire assembly 40 are inserted longitudinally within the interior space 21 of the housing 20 from opposite ends thereof until a pre-lock orientation (illustrated in FIGS. 4, 5, and 12) of such components is achieved. In this pre-lock orientation (best shown in FIG. 12), the locking surface 45 provided on the electrical terminal 41 is disposed adjacent to the terminal lock member 24 provided on the retaining finger 22 of the housing 20. As a result, the electrical terminal and wire assembly 40 cannot be withdrawn longitudinally from the housing 20. At the same time, the locking portion 31*a* of the terminal position assurance 30 is not disposed adjacent to the end of the retaining finger 22 of the housing 20. As a result, flexing movement of the retaining finger 22 relative to the housing 20 is not positively prevented, as will be explained in greater detail below.

Figure 13:
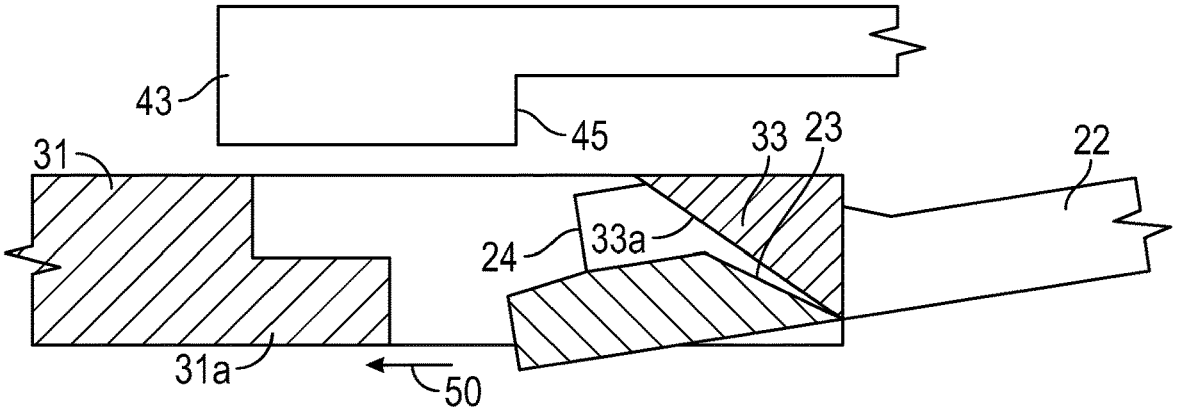
FIG. 13 is a schematic side elevational view showing the relative orientations of portions of the housing, the terminal position assurance, and the electrical terminal when the terminal position assurance is in the service position.
Figure 14:
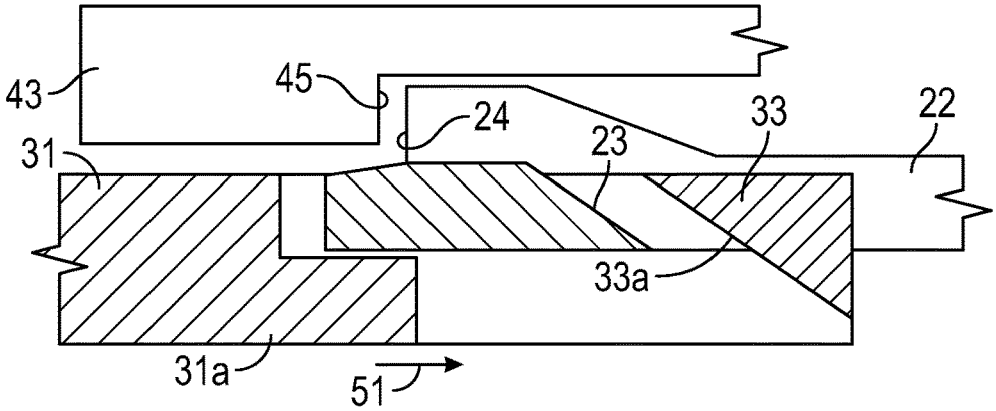
FIG. 14 is a schematic side elevational view showing the relative orientations of portions of the housing, the terminal position assurance, and the electrical terminal when terminal position assurance is in the lock position.

As shown in FIG. 5, when the terminal position assurance 30 is in the pre-lock position relative to the housing 20, the protrusions 35 provided on the terminal position assurance 30 are respectively disposed between the first retaining recesses 25 and the second retaining recesses 26 provided on the housing 20. Thus, as will be described in detail below, the terminal position assurance 30 can be moved longitudinally relative to the housing 20 in either a first direction (indicated by the arrow 50 in FIG. 13) or a second, opposite direction (indicated by the arrow 51 in FIG. 14). However, the maximum amount of such relative longitudinal movement in the first direction 50 is limited by the engagement of the first surfaces 35*a* provided on the protrusions 35 of the terminal position assurance 30 with the stop surfaces 25*a* provided on the first retaining recesses 25 of the housing 20. Similarly, the maximum amount of such relative longitudinal movement in the second direction 51 is limited by the engagement of the second surfaces 35*b* provided on the protrusions of the terminal position assurance 30 with the stop surfaces 26*a* provided on the second retaining recesses 26 of the housing 20.

The terminal position assurance 30 can be moved longitudinally relative to the housing 20 in the first direction 50 from the pre-lock position to a service position shown in FIGS. 6, 7, 8, and 13. In this service position (best shown in FIG. 13), the actuators 33 provided on the actuating arms 32 of the terminal position assurance 30 engage the angled actuating surface 23 provided on the retaining finger 22 of the housing 20. As a result, the retaining finger 22 of the housing 20 is deflected such that the terminal lock member 24 provided on the retaining finger 22 of the housing 20 is not disposed adjacent to the locking surface 45 provided on the electrical terminal 40. This is possible because, as described above, the locking portion 31*a* of the terminal position assurance 30 is not disposed adjacent to the end of the retaining finger 22 of the housing 20. As a result, the electrical terminal and wire assembly 40 can be withdrawn longitudinally from the interior space 21 of the housing 20. Consequently, the electrical terminal and wire assembly 40 can be released from the housing 20 (such as for repair or replacement) simply and quickly, without the need for any special tool or other device external to the electrical connector 10.

Figure 7:
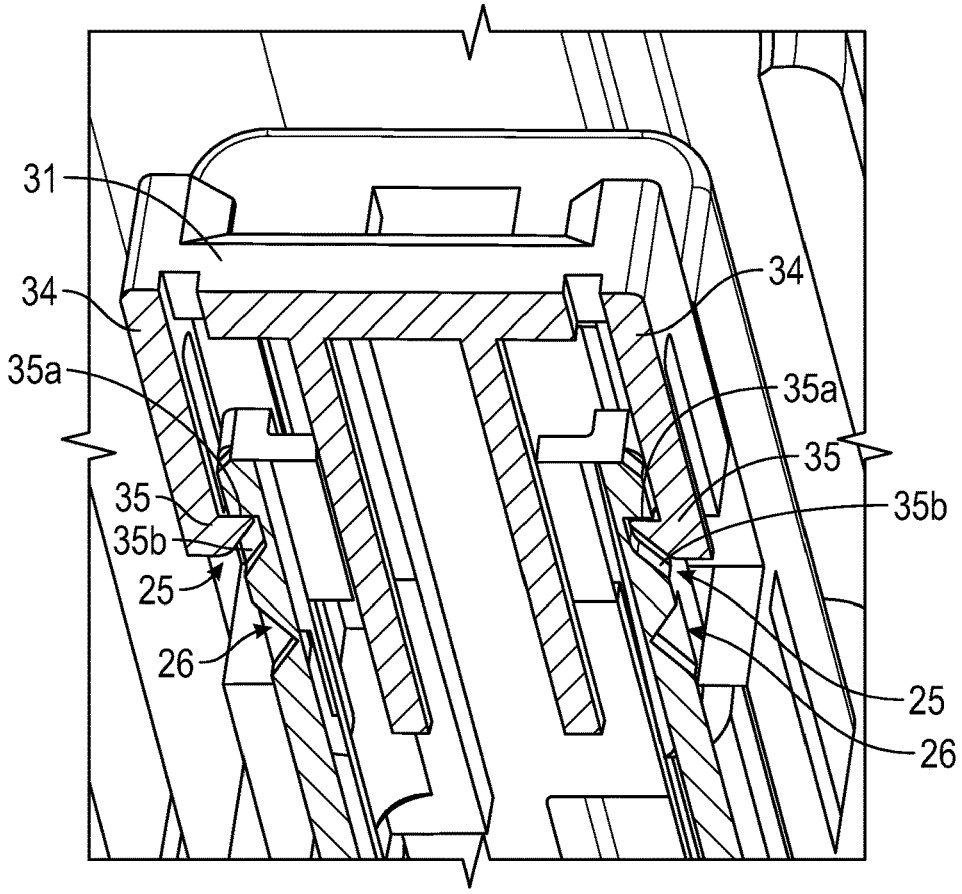
FIG. 7 is a bottom perspective view, partially in cross section, of the housing and the terminal position assurance shown in the service position illustrated in FIG. 6.

As best shown in FIG. 7, the extent of the longitudinal movement of the terminal position assurance 30 in the first direction 50 is limited by the engagement of the first surfaces 35*a* provided on the protrusions 35 of the terminal position assurance 30 with the stop surfaces 25*a* provided on the first positioning mechanisms 25 of the housing 20. When the terminal position assurance 30 is in the service position, the second surfaces 35*b* provided on the protrusions 35 of the terminal position assurance 30 engage (or at least are disposed adjacent to) the ramp surfaces 25*b* provided on the first positioning mechanisms 25 of the housing 20. Thus, the terminal position assurance 30 is positively maintained in the service position. However, the terminal position assurance 30 can be returned from the service position to the pre-lock position by applying a force to the terminal position assurance 30 in the second direction 51. When this occurs, the second surfaces 35*b* provided on the protrusions 35 of the terminal position assurance 30 engage and move over the ramp surfaces 25*b* provided on the first positioning mechanisms 25 of the housing 20 until the pre-lock position is achieved.

Alternatively, the terminal position assurance 30 can be moved longitudinally relative to the housing 20 in the second direction 51 from the pre-lock position to a lock position shown in FIGS. 9, 10, 11, and 14. In this lock position (best shown in FIG. 14), the actuators 33 provided on the actuating arms 32 of the terminal position assurance 30 do not engage the angled actuating surface 23 provided on the retaining finger 22 of the housing 20. As a result, the retaining finger 22 of the housing 20 is not deflected, and the terminal lock member 24 provided on the retaining finger 22 of the housing 20 is maintained adjacent to the locking surface 45 provided on the electrical terminal 41. At the same time, the locking portion 31*a* of the terminal position assurance 30 is disposed adjacent to the end of the retaining finger 22 of the housing 20. As a result, the electrical terminal and wire assembly 40 cannot be withdrawn longitudinally from the housing 20.

Figure 10:
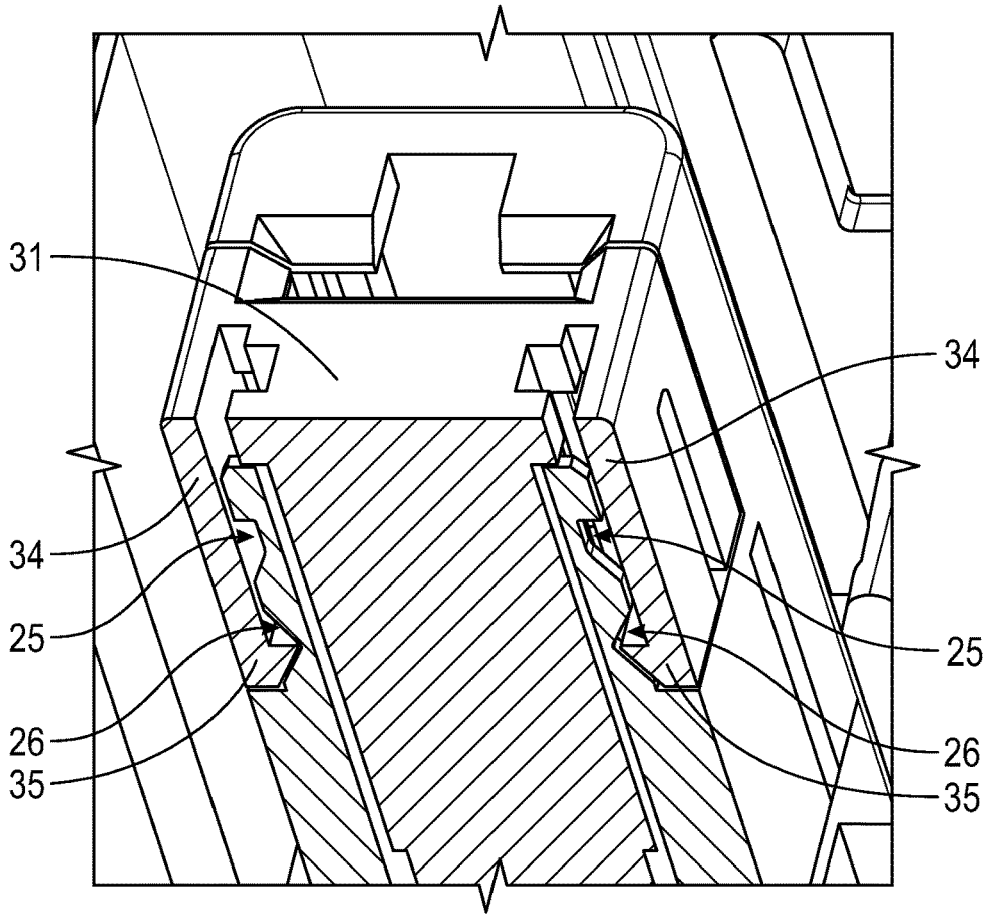
FIG. 10 is a bottom perspective view, partially in cross section, of the housing and the terminal position assurance shown in the lock position illustrated in FIG. 9.

As best shown in FIG. 10, the extent of the longitudinal movement of the terminal position assurance 30 in the second direction 51 is limited by the engagement of the second surfaces 35*b* provided on the protrusions 35 of the terminal position assurance 30 with the stop surfaces 26*a* provided on the second positioning mechanisms 26 of the housing 20. When the terminal position assurance 30 is in the lock position, the first surfaces 35*a* provided on the protrusions 35 of the terminal position assurance 30 engage (or at least are disposed adjacent to) the ramp surfaces 26*b* provided on the second positioning mechanisms 26 of the housing 20. Thus, the terminal position assurance 30 is positively maintained in the lock position. However, the terminal position assurance 30 can be returned from the lock position to the pre-lock position by applying a force to the terminal position assurance 30 in the first direction 50. When this occurs, the first surfaces 35*a* provided on the protrusions 35 of the terminal position assurance 30 engage and move over the ramp surfaces 26*b* provided on the second positioning mechanisms 26 of the housing 20 until the pre-lock position is achieved.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector comprising:

a housing having an interior space and a retaining finger extending into the interior space;

an electrical terminal disposed within the interior space of the housing; and a terminal position assurance disposed within the interior space of the housing and movable relative to the housing between:

(1) a pre-lock position, wherein the retaining finger prevents the electrical terminal from being withdrawn from the interior space of the housing, and the terminal position assurance does not prevent the retaining finger from moving relative to the housing;

(2) a service position, wherein the retaining finger does not prevent the electrical terminal from being withdrawn from the interior space of the housing; and (3) a lock position, wherein the retaining finger prevents the electrical terminal from being withdrawn from the interior space of the housing, and the terminal position assurance prevents the retaining finger from moving relative to the housing.

2. The electrical connector defined in claim 1 wherein the retaining finger is formed integrally with the housing and extends in a cantilevered manner within the interior space.

3. The electrical connector defined in claim 1 wherein the retaining finger engages the terminal position assurance when the terminal position assurance is in the service position such that the retaining finger does not prevent the electrical terminal from being withdrawn from the interior space of the housing.

4. The electrical connector defined in claim 3 wherein the retaining finger includes an angled actuating surface that engages an angled actuating surface provided on the terminal position assurance when the terminal position assurance is in the service position.

5. The electrical connector defined in claim 1 wherein the retaining finger includes a lock member that is disposed adjacent to a locking surface provided on electrical terminal when the terminal position assurance is in the pre-lock position.

6. The electrical connector defined in claim 1 wherein the retaining finger includes a lock member that is disposed adjacent to a locking surface provided on electrical terminal when the terminal position assurance is in the lock position.

7. The electrical connector defined in claim 1 wherein the retaining finger includes a lock member that is disposed adjacent to a locking surface provided on electrical terminal when the terminal position assurance is in both the pre-lock position and the lock position.

8. The electrical connector defined in claim 1 wherein the terminal position assurance includes a locking portion that is disposed adjacent to the retaining finger when the terminal position assurance is in the lock position.

9. The electrical connector defined in claim 1 wherein the terminal position assurance is movable in a first direction from the pre-lock position to the service position.

10. The electrical connector defined in claim 9 wherein the terminal position assurance is movable a second direction from the pre-lock position to the lock position.

11. The electrical connector defined in claim 10 wherein the first direction is opposite to the second direction.

12. The electrical connector defined in claim 1 wherein the terminal position assurance includes a pair of actuating arms that terminate in respective actuators that engage the terminal position assurance when the terminal position assurance is in the service position such that the retaining finger does not prevent the electrical terminal from being withdrawn from the interior space of the housing.

* * * * *